US010059139B2

(12) United States Patent
Mueller

(10) Patent No.: US 10,059,139 B2
(45) Date of Patent: Aug. 28, 2018

(54) COVER FEEDER AND METHOD FOR SUPPLYING BOOK COVERS

(71) Applicant: MUELLER MARTINI HOLDING AG, Hergiswil (CH)

(72) Inventor: Hans Mueller, Lauda Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/414,614

(22) Filed: Jan. 24, 2017

(65) Prior Publication Data

US 2017/0239971 A1 Aug. 24, 2017

(30) Foreign Application Priority Data

Feb. 19, 2016 (CH) ..... 232/16

(51) Int. Cl.
*B42C 19/08* (2006.01)
*B65H 1/30* (2006.01)
(Continued)

(52) U.S. Cl.
CPC ..... *B42C 19/08* (2013.01); *B42C 1/00* (2013.01); *B42C 11/04* (2013.01); *B65H 1/30* (2013.01);
(Continued)

(58) Field of Classification Search
CPC .. B65H 1/30; B65H 29/22; B42C 1/00; B42C 19/08; B42C 11/04
(Continued)

(56) References Cited

U.S. PATENT DOCUMENTS 6,386,812 B2 * 5/2002 Garlichs ..... B42C 11/02 198/471.1
6,769,676 B2 * 8/2004 Machon ..... B42C 7/00 270/52.18
(Continued)

FOREIGN PATENT DOCUMENTS

DE 94 03 531 U1 5/1994
EP 2386507 A1 11/2011
EP 2508354 A1 10/2012

OTHER PUBLICATIONS

International Search Report for 00232/16, dated May 27, 2016, and English translation thereof.

*Primary Examiner* — Patrick Cicchino
(74) *Attorney, Agent, or Firm* — Fisherbroyles, LLP; Robert Kinberg

(57) ABSTRACT

A cover feeder for providing book covers to a production unit of a book completion line includes a first receiving device for book covers of the same format, which can be positioned individually, in an overlapping flow and/or in a stack thereon, and a second receiving device that is arranged upstream of the first receiving device for a stack of book covers having different formats. The cover feeder includes a control unit to which information can be transmitted relating to the format and sequence of book covers in the stack of book covers having different formats, and a laterally adjustable centering device connected to the control unit for a defined lateral displacement and/or aligning of respectively one book cover that is separated out from the second receiving device and is positioned on the first receiving device.

20 Claims, 13 Drawing Sheets

(51) Int. Cl.

| | |
|---|---|
| ***B65H 29/22*** | (2006.01) |
| ***B42C 11/04*** | (2006.01) |
| ***B65H 83/02*** | (2006.01) |
| ***B42C 1/00*** | (2006.01) |
| ***B65H 9/00*** | (2006.01) |

(52) U.S. Cl.
CPC ..... *B65H 9/00* (2013.01); *B65H 29/22* (2013.01); *B65H 83/02* (2013.01); *B42P 2261/04* (2013.01)

(58) Field of Classification Search
USPC ..... 271/3.05, 3.13
See application file for complete search history.

(56) References Cited

U.S. PATENT DOCUMENTS

| | | | | |
|---|---|---|---|---|
| 6,843,473 | B2 * | 1/2005 | Bohn | B42C 19/08 270/52.18 |
| 8,579,274 | B2 * | 11/2013 | Mueller | B42C 11/04 270/52.2 |
| 8,613,436 | B2 * | 12/2013 | Tas | B42C 7/005 270/52.17 |
| 2012/0255889 | A1 | 10/2012 | Mueller | |

* cited by examiner

COVER FEEDER AND METHOD FOR SUPPLYING BOOK COVERS

CROSS-REFERENCE TO RELATED APPLICATION

Priority is claimed to Swiss Application No. CH 00232/16, filed Feb. 19, 2016, the disclosure of which is incorporated herein by reference in its entirety.

BACKGROUND OF THE INVENTION

The invention relates to a cover feeder for supplying book covers to a production unit in a book completion line, comprising a first receiving device for book covers of a single format, deposited either individually, in an overlapping flow and/or in a stack, a laterally adjustable centering device arranged on the first receiving device which is laterally displaceable for a defined feeding from the side of individual, overlapping and/or stacked book covers, corresponding to a centering required for the production unit of the book completion line, a cover magazine with a stacking chute arranged downstream of the first receiving device, and a first separating out unit for withdrawing the lowest book cover from the stacking chute and for supplying the withdrawn book cover to the production unit of the book completion line. In addition, the invention relates to a corresponding method for supplying the book covers.

Known book completion lines successively combine at clocked intervals respectively one book block and one book cover. For this, the book blocks and the book covers are normally produced in separate machines. The book block is subjected in individual processing stations to various processing steps, for example rounding, pressing, applying of glue to the back and the application of a headband. Separate therefrom, the book cover generally moves through a cover bending device before a so-called marriage takes place in a downstream-arranged casing-in machine, meaning a joining of the book block and the book cover.

Generally speaking, medium to large editions of books are processed in conventional book completion lines of this type. The same number of identical book covers are thus supplied to match a series of identical book blocks. It is therefore not necessary to watch the sequence because one book is combined in the same way as the other ones with this type of edition. The book covers in this case are supplied while stacked, in part also overlapping, on a cover magazine, wherein the stack is composed of book covers with the same format, meaning the same dimensions.

European patent document EP2386507 A1 describes a cover feeder as described in the above for supplying book covers to a production unit of a book completion line, embodied as a casing-in machine, in which the so-called marriage of book block and book cover takes place, meaning the joining to form a book.

This cover feeder comprises a receiving device for book covers with a side guiding device, arranged on its drive side, and a downstream-arranged cover magazine with a stacking chute, as well as an adjacent separating out device. In contrast to traditional cover feeders, which contain only a single stack of book covers of the same format on the receiving device, a first stack of book covers having a first format and a second stack with book covers having a second format, which deviates from the first format, can be provided on this book cover feeder for processing small editions with only a few books. Accordingly, two stacks of book covers with respectively different format can be processed sequentially, wherein the format change from the first stack available in production direction to the next stack occurs automatically. In the extreme case of a micro-edition, e.g. when producing a photo album or single book, such a stack consists of a single book cover. The book cover as well as the associated book block therefore are unique, which respectively requires a clear identification.

In the field of modern industrial book binding, orders for small editions and micro-editions frequently alternate. With an increasing share of micro-editions, however, it becomes uneconomical to place a number of book covers with differing formats successively onto the cover feeder while stacks of identical book covers are placed on for small editions.

SUMMARY OF THE INVENTION

An object of the invention therefore is to create a cover feeder and a method for supplying book covers to a following production unit of a book completion line, which allow an economic processing of successively following book covers of the same formats and book covers having different formats in an optional sequence.

The above and other objects are achieved according to an embodiment of the invention with a cover feeder for providing book covers to a production unit of a book completion line, the cover feeder comprising: a first receiving device having a transporting direction and receiving book covers of a same format that are deposited at least one of individually, in an overlapping flow and in a stack on the first receiving device; a laterally adjustable centering device arranged on the first receiving device for a defined feeding from a side of the first receiving device, relative to the transporting direction, of the book covers deposited individually, in an overlapping flow or in the form of a stack, to a position corresponding to a centering required for the production unit of the book completion line; a cover magazine, arranged downstream of the first receiving device, comprising a stacking chute and a first separating out device for withdrawing a respectively lowest book cover from the stacking chute and for providing the withdrawn book cover to the production unit of the book completion line; a second receiving device arranged upstream of the first receiving device for accommodating a stack of book covers having different formats, the second receiving device comprising a second separating out device for withdrawing a respectively lowest book cover from the stack of book covers having different formats, which stack rests on the second receiving device, and for conveying in the transporting direction of the first receiving device the separated out book covers of different formats to the first receiving device; and a control unit to which information is transmitted relating to the format and sequence of the book covers in the stack of book covers with different formats; wherein the centering device is connected to the control unit for being controlled to be laterally displaced to effect a defined lateral displacement for aligning the respective book covers withdrawn from the second receiving device and positioned on the first receiving device corresponding to the information on format and sequence of the book covers in the stack of book covers with different formats and corresponding to the centering required for the production unit of the book completion line.

Thus, with the apparatus according to the invention, a second receiving device for a stack of book covers having different formats is arranged upstream of the first receiving device. The second receiving device comprises a second separating out device for withdrawing the respectively lowest book cover from the stack of book covers with different formats, positioned on the second receiving device, and for further conveying the separated out book cover in the transporting direction to the first receiving device. The cover feeder is furthermore provided with a control unit to which information can be transmitted relating to the format and sequence of the book covers in the stack of book covers having different formats. The centering device is connected to the control unit of the cover feeder and is embodied to be laterally displaceable for a defined lateral displacement and/or alignment of a book cover, separated out from the second receiving device and positioned on the first receiving device, corresponding to the information on the format and sequence of book covers in the stack of book covers having different formats and corresponding to the centering required for the production unit of the book completion line. With this type of apparatus, book covers of the same as well as different formats, which are supplied in a stack, can be processed successively and, following the separating out, can be supplied with the required centering to a following production unit of a book completion line. An economic processing of small and micro editions is thus possible.

The centering device according to one embodiment of the apparatus comprises a single centering element. Stacks of book covers having the same format can thus be placed easily and cost-effectively onto the first receiving device, given a corresponding presetting of the centering element with the centering required for the downstream production unit of the book completion line. Also, book covers having different formats, withdrawn from the stacks, which are positioned on the second receiving device and are transported to the first receiving device, can be laterally displaced and/or aligned on the first receiving device, corresponding to the information relating to format and sequence of the book covers in this stack and the centering required for the production unit of the book completion line.

According to a different embodiment of the inventive apparatus, at least one stacking device is provided for forming a stack of book covers having different formats and centered in the middle, which is embodied such that it can be transported to the second receiving device. With a stacking device of this type, book cover stacks suitable for further processing can be formed easily with prefinished book covers having different formats, by depositing these book covers in a specific sequence one on top of the other, corresponding to the sequence of books to be completed by joining the book blocks and the respectively associated book covers, wherein these stacks can subsequently be supplied to the second receiving device of the cover feeder.

According to another embodiment of the apparatus according to the invention, the at least one stacking device comprises a roof-shaped support surface with a ridge oriented (inclined) toward the top or the bottom for accommodating book covers of different formats and a support surface for the leading edges of the book covers in the stack to be formed. As a result of this design, book covers having different formats can essentially be supplied centered in the middle to the stacking device, wherein the leading edges of the book covers rest against the contact surface. An essentially defined stack forming is thus ensured in the stacking device.

According to yet another embodiment of the inventive apparatus, the roof-shaped support surface is slanted in the direction of the contact surface, thereby making possible a further improvement in the stack formation.

The contact surface for a different embodiment of the inventive apparatus is provided in the region of the ridge with a first recess that is open toward the top, and the roof-shaped support surface is provided with at least a second recess in the region of the contact surface and the ridge. A machine operator can thus grasp the stack of book covers of different formats and remove it particularly easily from the stacking device.

With yet another embodiment of the apparatus, a first sensor is connected to the control unit of the cover feeder and is embodied such that it is, or can be directed toward detecting an identifier relating to the format and sequence of the book covers in the stack of book covers having different formats which stack is positioned on the second receiving device or on the at least one stacking device. The respectively current order to be processed can be detected with the aid of this identifier and the first sensor in the control unit. The sequence and formats of the book covers in the stack can be determined in the control unit connected to this sensor, and this information can then be used for the post-processing.

The first sensor, for example, can be attached to the second receiving device of the cover feeder or to the area immediately surrounding it, but can also be moved by a machine operator close to the stack of book covers having different formats and can be directed toward this stack.

According to a different embodiment of the apparatus, the identifier relating to the format and sequence of book covers in the stack of book covers having different formats is attached to at least one book cover in this stack and/or a separate identifier is attached to the device for forming this stack. The identifier in principle can be attached to an optional position on the stack, detectable by the sensor, for example to the top book cover in the stack or even a cover sheet resting on the stack.

The identifier and/or the separate identifier can be in the form of a numbering of the respective stack of book covers with different formats, which can be combined in the control unit with an information associated with this numbering. The identifier and/or the separate identifier can also be present as a code which itself contains the information relating to the format and sequence of the book covers in the stack of book covers having different formats.

According to a different embodiment of the inventive apparatus, several stacking devices are provided, and a separate identifier for their identification is arranged on each stacking device. On the one hand, several stacks with book covers having different formats can thus be formed, independent of the further processing in the cover feeder while, on the other hand, the identification of the respective stack is ensured via the individual identifiers attached to the stacking device.

According to another embodiment of the inventive apparatus, a second sensor is arranged on the cover feeder for identifying the book covers withdrawn from the second receiving device and the book covers conveyed further to the first receiving device and is connected to the control unit of the cover feeder. With this sensor, the control unit, and a conveying device for the second receiving device that is connected to the latter, a previously separated-out book cover that still rests partially on the second receiving device can initially be identified, can be stopped and is only deposited in the conveying region of the first receiving device once the preceding book cover has been moved from the first receiving device to the downstream arranged cover magazine. With the aid of this second sensor, it can furthermore be checked whether the currently separated out book cover matches the dataset stored in the control unit for a corresponding book cover.

According to yet another embodiment of the inventive apparatus, a third sensor is arranged on the cover feeder, which is directed toward a downstream region of the first receiving device and is connected to the control unit of the cover feeder. With the aid of this sensor, the control unit and a conveying device for the first receiving device that is connected to the latter, the book cover can be identified and stopped once it is located in the region of the laterally adjustable centering device. The book cover can thus be moved precisely to the required position for the lateral displacement and/or alignment corresponding to the information relating to format and sequence for the covers in the stack of book covers having different formats and corresponding to the requirements for the production unit of the book completion line.

According to yet another embodiment of the inventive apparatus, a fourth sensor is arranged on the cover feeder which detects a gap between two successively following book covers withdrawn from the second receiving device and is connected to the control unit for the cover feeder. With the aid of this sensor, the control unit and a conveying device for the second receiving device that is connected to the latter, the front edge of a book cover withdrawn from the second receiving device can be stopped at a location where the second sensor can read the identifier of this book cover.

According to a different embodiment of the inventive apparatus, a clocked load element is arranged in a downstream region of the first receiving device, for pressing the book covers positioned individually, in an overlapping flow and/or in the form of a stack onto the first receiving device. A premature tipping of the respective book cover(s) into the downstream arranged cover magazine and thus an undesirable deviation of the book cover(s) from the previously adjusted lateral position and/or alignment can be prevented in this way.

Corresponding to a different embodiment of the inventive apparatus, the first and the second receiving devices are embodied such that a first imaginary vertical plane through a first center axis of the first receiving device, oriented parallel to the transporting direction, is spaced transverse to the conveying direction to the side by a specific distance, from a second imaginary vertical plane, oriented parallel to the transporting direction, through a second center axis of the second receiving device. With reference to the transporting direction, the centering device is arranged on a side of the first receiving device which is closer to the second imaginary vertical plane through the second center axis of the second receiving device extended into the first receiving device, than to the first imaginary vertical plane through the first center axis of the first receiving device.

Following the separating out and during the further transport in the cover feeder, the book covers supplied to the second receiving device of the cover feeder in the form of a stack of book covers having different formats can thus be supplied already centered in the middle and can finally be turned over to the following production unit in the book completion line, such that a high-quality book is created after combining the respective book cover with the associated book block. In addition, it is technically easier and cheaper to always displace the book covers in the same direction, regardless of their format and how far they were originally displaced centrally, so that only the relative amount of the displacement changes.

According to another embodiment of the inventive apparatus, the second receiving device is provided with a support surface for the stack of book covers having different formats, which support surface is provided with a marking of the vertical plane through its center axis. This marking is advantageously used by the machine operator for the centered depositing of the stack of book covers with different formats onto the support surface and/or in the second receiving device.

The method according to the invention provides that in addition to or alternative to placing book covers individually, in an overlapping flow or in the form of a stack of book covers having the same format onto the first receiving device, a stack of book covers having different formats is placed upstream of the first receiving device onto the second receiving device. The respectively lowest book cover in the stack of book covers with different formats, positioned on the second receiving device, is furthermore withdrawn and transported in conveying direction to the first receiving device. Information regarding the format and sequence of book covers in the stack of book covers with different formats is furthermore transmitted to the control unit of the cover feeder. Finally, based on a signal created by the control unit with the aid of the information relating to format and sequence for the book covers in the stack of book covers having different formats, the book cover separated out from the second receiving device and placed onto the first receiving device is respectively displaced to the side and/or aligned corresponding to the centering required for the production unit of the book completion line.

In this way, the book covers supplied in the form of a stack, having the same as well as different formats, can be processed successively and, following a corresponding separating out, can be made available with the required centering to a following production unit of a book completion line, thereby making possible an economic processing of small and micro editions.

Corresponding to one embodiment of the inventive method, the stack of book covers having different formats is supplied while centered in the middle, extending transverse to the transporting direction, and is deposited onto the second receiving device with the edges of the book covers in this stack coming in contact with at least one holding back device of a second separating out device for the second receiving device.

Corresponding to a different embodiment of the inventive method, the book covers in the stack are deposited centered in the middle, relative to each other, on a marking for the second receiving device. A mostly centered depositing of the stack of book covers having different formats onto the support surface and/or the second receiving device can thus be ensured.

Corresponding to another embodiment of the inventive method, a stack containing book covers with different formats, centered in the middle, is formed with the aid of at least one stacking device, the stacking device with the stack is then transported to the second receiving device where the stack is removed from the stacking device and is deposited on the second receiving device. Stacks of book covers having different formats can thus easily be formed, using a specific stacking sequence, suitable for the further processing, which corresponds to the sequence for the books to be produced in the book completion line by joining the book blocks and the associated book covers. These stacks are then transported to the second receiving device of the cover feeder.

Corresponding to a different embodiment of the inventive method, the information relating to the format and sequence of the book covers in the stack of book covers having different formats takes the form of an identifier affixed to at least one book cover in this stack or to a stacking device used to form this stack. The identifier, for example, can take the form of a numbering of the respective stack of book covers having different formats, which the control unit combines with an information belonging to this numbering. In the same way, the identifier can take the form of a code which itself contains the information on the format and sequence of the book covers in the stack book covers having different formats.

BRIEF DESCRIPTION OF THE DRAWINGS

The invention is described in the following with the aid of an exemplary embodiment, wherein.

DETAILED DESCRIPTION OF THE INVENTION

Figure 1:
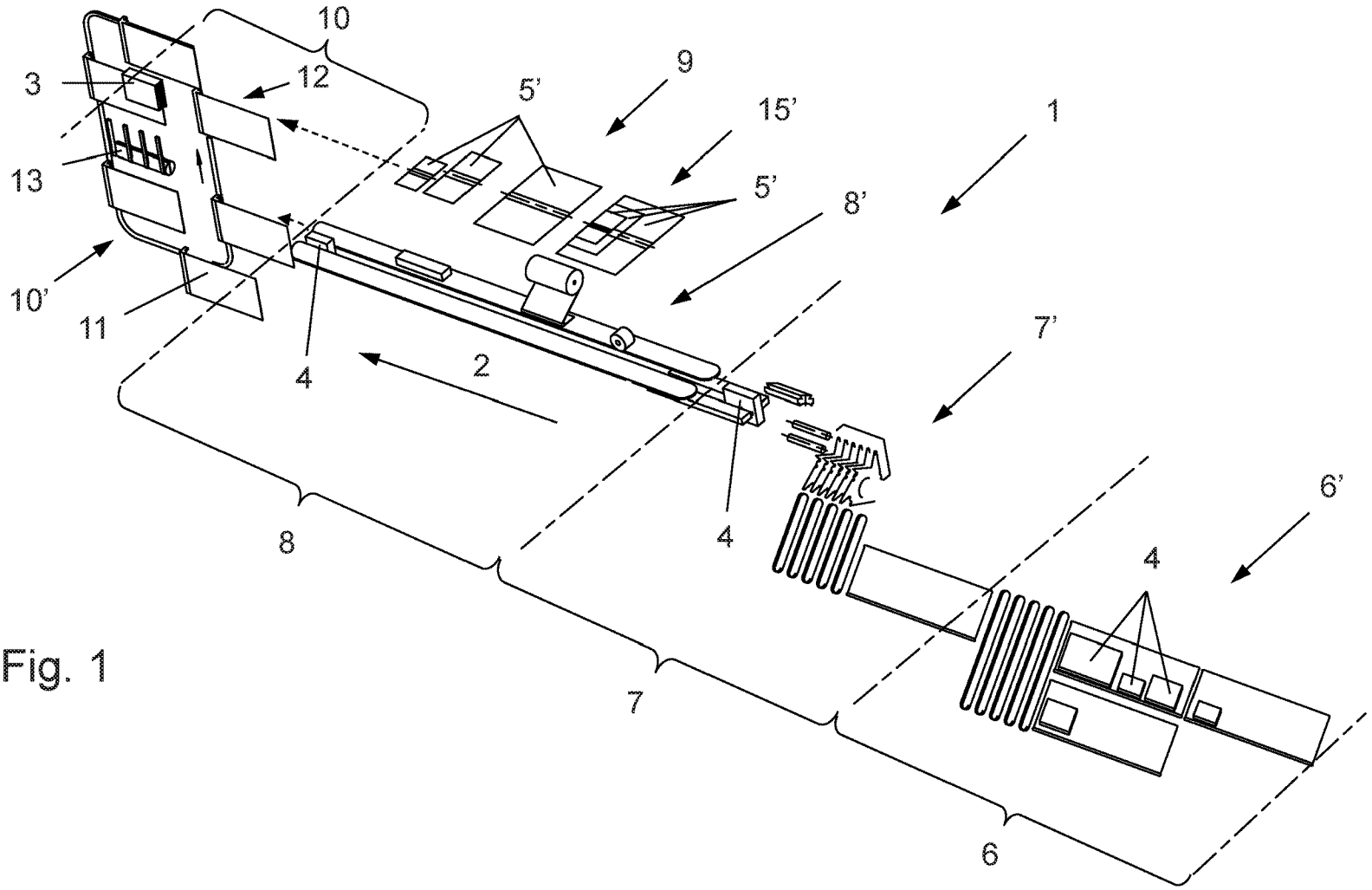
FIG. 1 is a schematic representation of a book completion line with the cover feeder according to the invention, in this case indicated only by the book covers resting thereon, as well as with a following production unit embodied as a casing-in machine.

FIG. 1 shows an exemplary embodiment of a book completion line 1 which is divided into successive operating regions, as seen in main production direction 2. The operating regions in this case are representative of different production units in the book completion line 1 that are provided with a separate drive, not shown herein, and which can be adjusted individually to the respective formats of the books to be produced and/or the book blocks 4 and book covers 5, 5' which are joined to form a finished book 3.

According to FIG. 1, the book completion line 1 has an upstream-arranged first operating region 6 for supplying book blocks 4 with different formats that follow each other individually that is provided with a first production unit 6' embodied as a feeding device. Of course, book blocks 4 having the same format can also be processed on the book completion line 1. The first operating region 6 is followed by a second operating region 7, provided with a second production unit 7' embodied as rounding and pressing machine for the rounding and pressing of the supplied book blocks 4.

In the main production direction 2, downstream of the second operating region 7, a third operating region 8 is provided for applying adhesive and for backlining the respective back of the rounded or straight and pressed or non-pressed book block 4 with the aid of a third production unit 8' embodied as back-lining machine. A cover feeder 9 according to the invention, which also belongs to the third production unit 8', is arranged essentially parallel to the back-lining machine, for picking up and, if applicable, separating out and making available the book covers 5, 5'.

The third operating region 8 is followed by a fourth operating region 10 with a fourth production unit 10', embodied as casing-in machine. The casing-in machine shown herein comprises a number of vertical-storage type circulating saddle plates 11. These function to take over book blocks 4, supplied individually from the back-lining machine, and for transporting these book blocks 4 in a counter-clockwise direction to a location 12 where a book block 4 is combined with the respectively associated book cover 5, 5' which is supplied by the cover feeder 9. The books 3 formed in this way are removed at a delivery location 13 from the casing-in machine, so that the circulating saddle plate 11 is again available for taking over a book block 4.

Depending on the arrangement and design of the individual production units 6', 7', 8', 10', a different configuration of the book completion line 1 is also possible.

Figure 2:
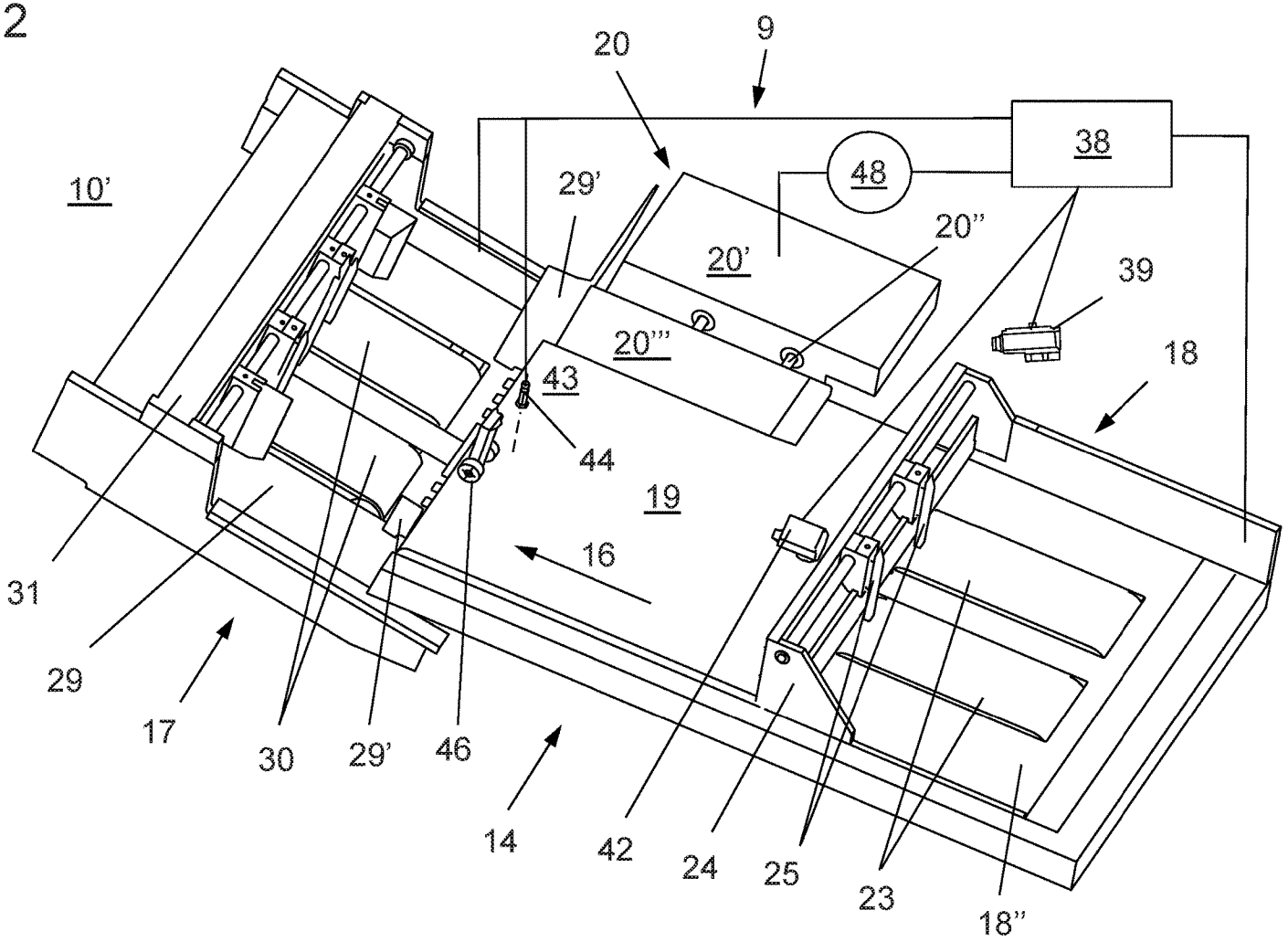
FIG. 2 is a perspective view from the top onto a cover feeder according to the invention, without book covers placed thereon.
Figure 5:
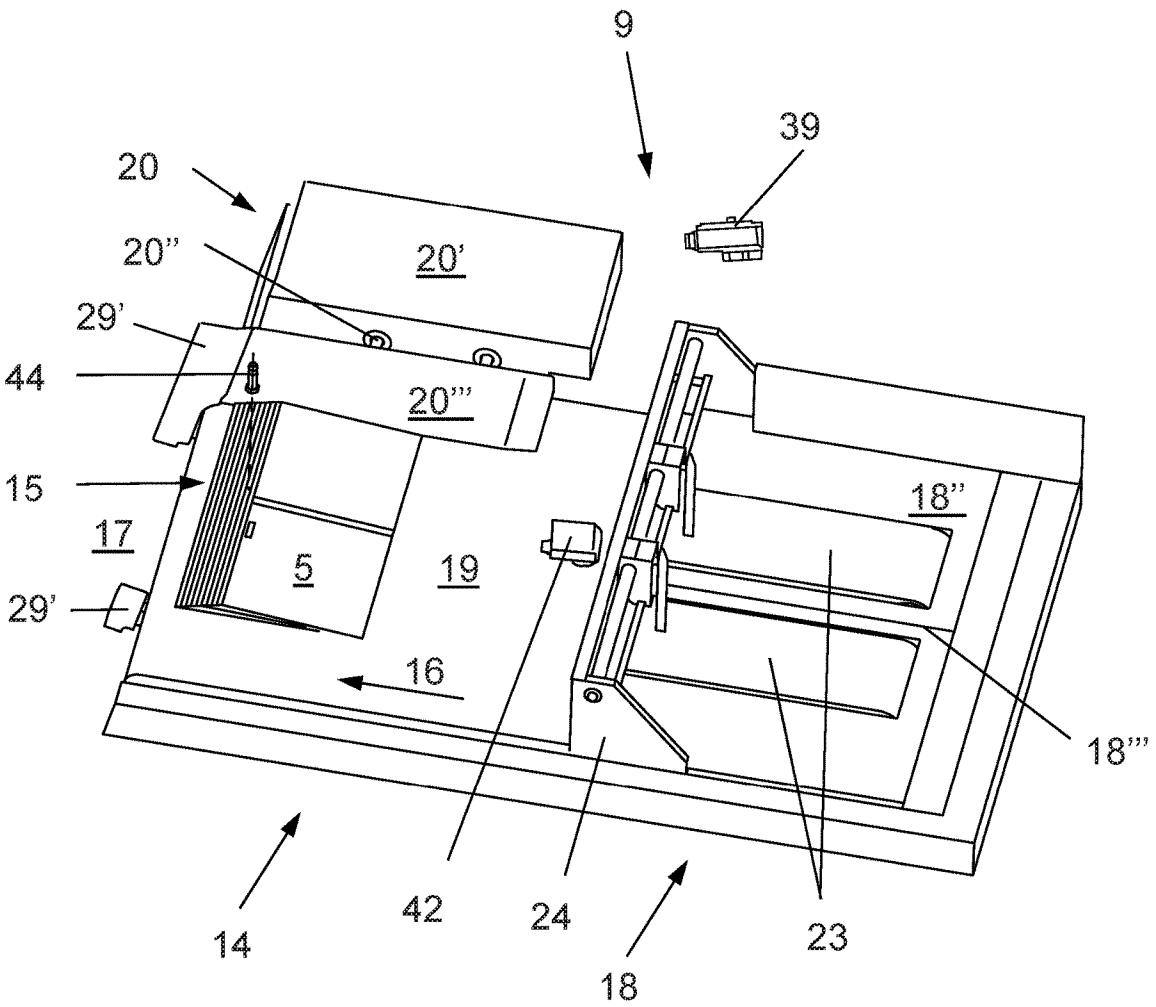
FIG. 5 is a representation limited only to the first and second receiving device of the cover feeder according to the invention, with a stack of book covers of the same format resting on the first receiving device.
Figure 6:
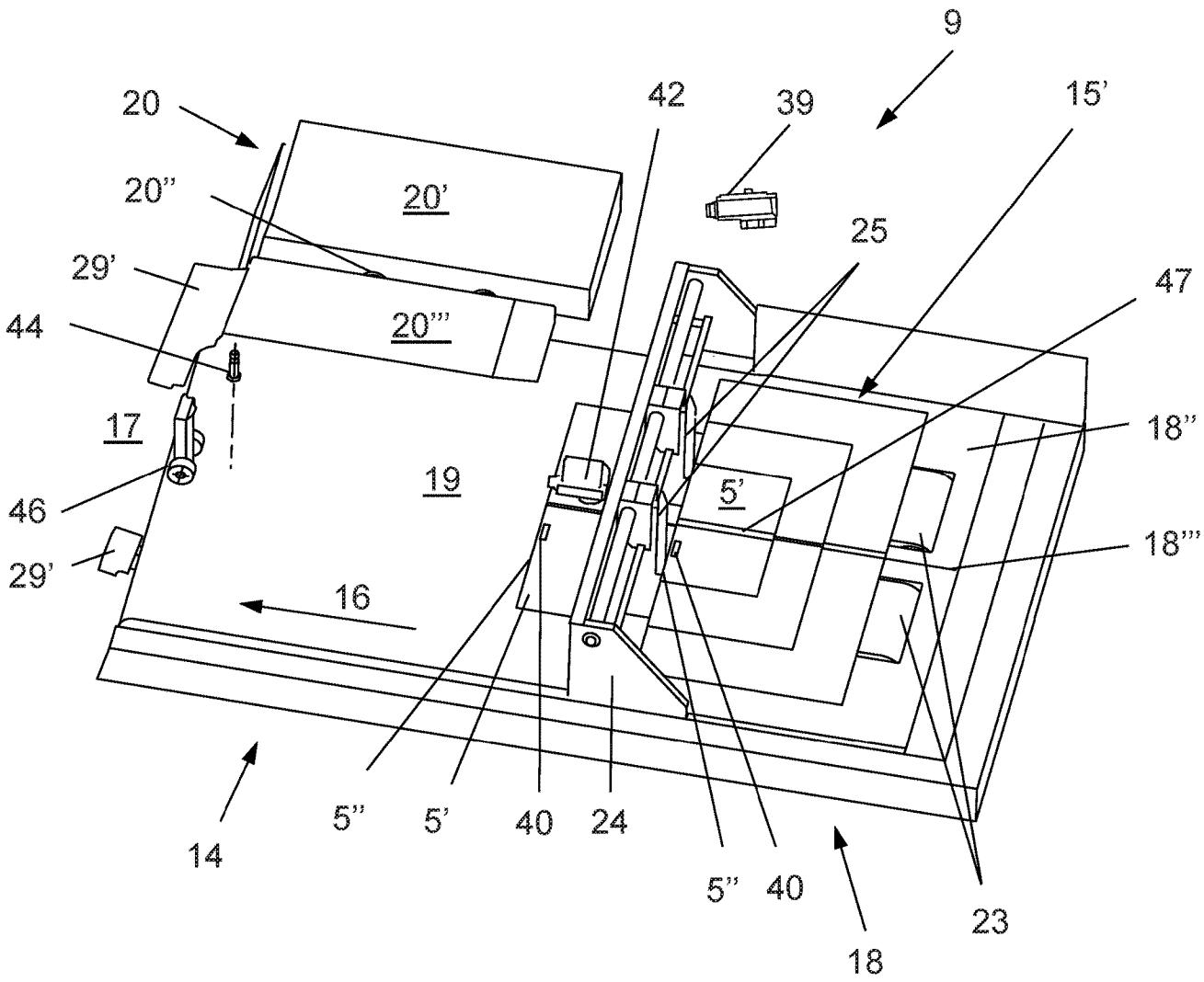
FIG. 6 is a representation of the cover feeder analogous to FIG. 5, but containing only a stack of book covers of different formats resting on the second receiving device.

FIG. 2 shows a cover feeder 9 according to the invention with a first receiving device 14 for book covers 5 (see FIG. 5) of respectively one format, which can be placed on individually, in an overlapping flow and/or as a first stack 15. With reference to a longitudinal transporting direction 16 for transport of the book covers 5, shown in FIG. 2, from right to left, the cover feeder 9 comprises a cover magazine 17, arranged downstream of the first receiving device 14, and a second receiving device 18, arranged upstream of the first receiving device 14, for a stack 15' of book covers 5' having different formats (FIG. 6).

Figure 3:
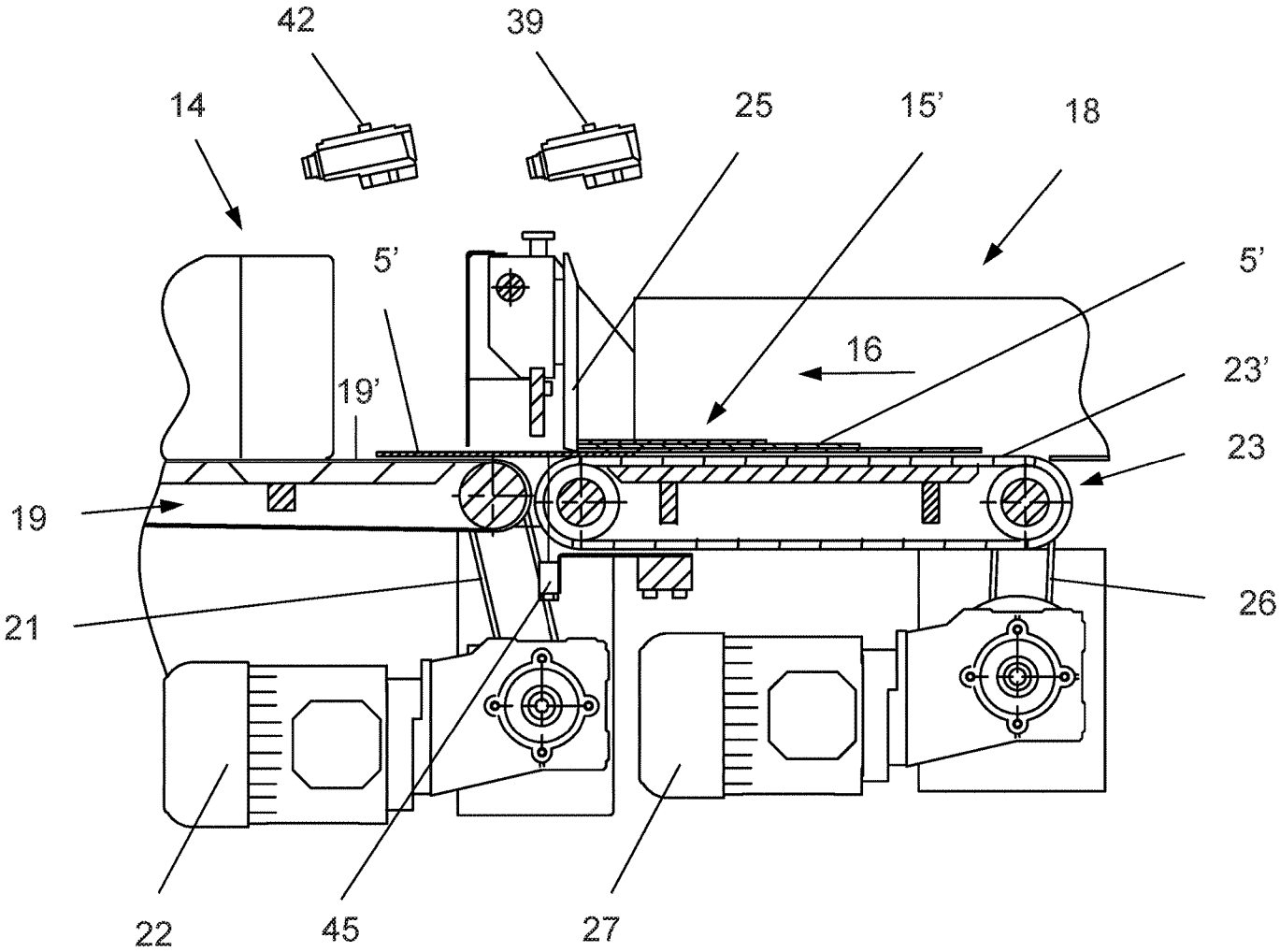
FIG. 3 is a partial sectional view through an inventive cover feeder, comprising the respective transport elements and the drives for the two receiving devices.

The first receiving device 14 comprises a conveying device 19, for example embodied as a conveyor belt, onto which the book covers 5 of the same format (FIG. 5) are placed, as well as a laterally adjustable centering device 20 with a basic element 20' and a single centering element 20''' that can be laterally displaced relative to the transporting direction 16, and consists, for example, of two guide rods 20'' for the defined feeding from the side of these book covers 5, corresponding to the centering required for the fourth production unit 10' in the book completion line 1 which is embodied as a casing-in machine. The first conveying device 19 is connected via a first chain drive 21 to a first drive motor 22 (FIG. 3).

Figure 9:
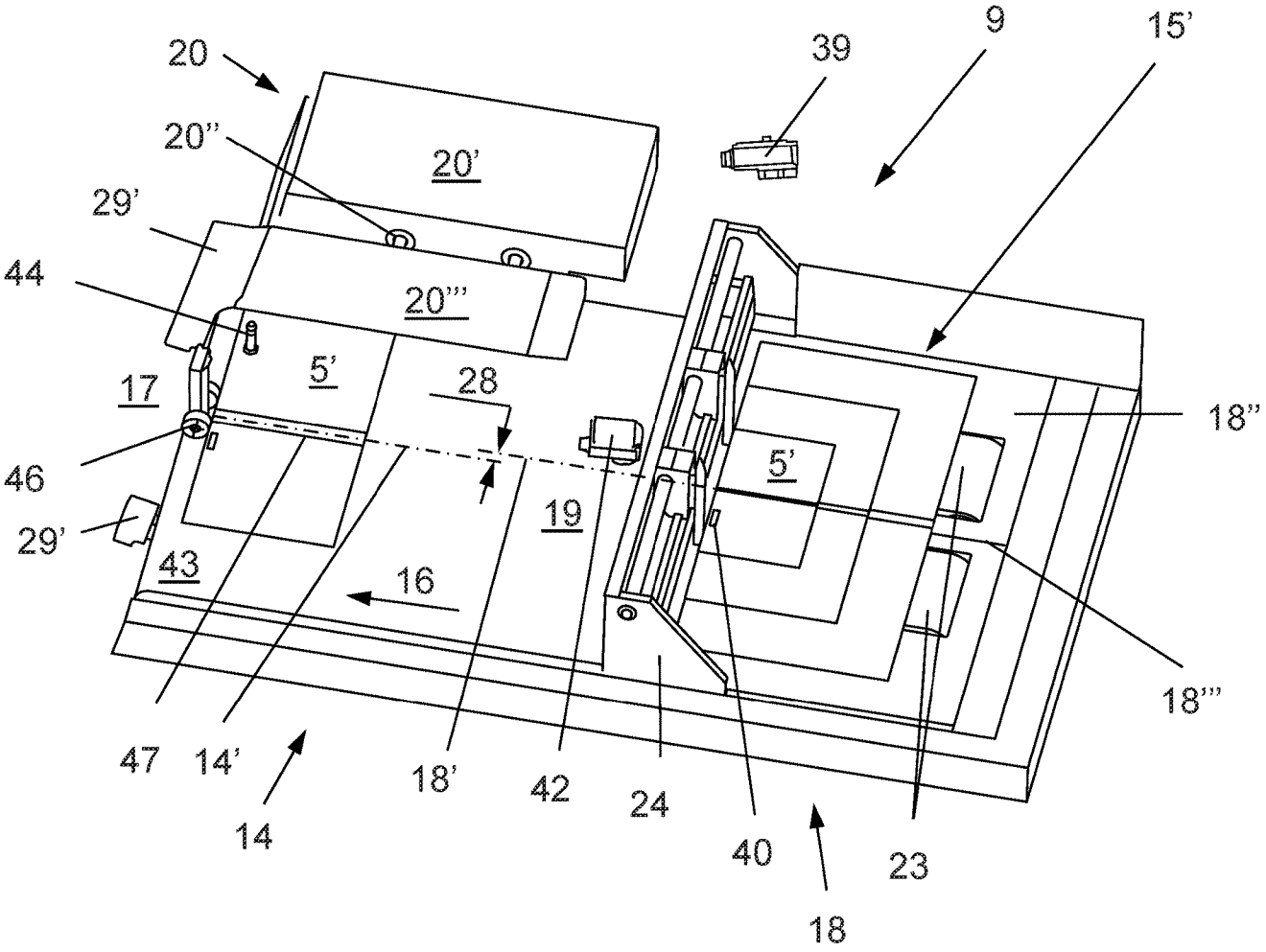
FIG. 9 is a representation of the cover feeder analogous to FIG. 8, but showing a later instant during the processing.

The second receiving device 18 is equipped with a conveying device 23, formed by two spaced-apart conveying belts that are arranged symmetrical to each other. In addition, it comprises a second separating out device 24 and two holding back devices 25 for withdrawing from the stack 15' of book covers 5' with differing formats only the lowest book cover 5' that rests frictionally adhering on the two conveying belts, located in the second receiving device 18, so as to transport the separated out book cover 5' further in transporting direction 16 to the first receiving device 14 (FIG. 3). With respect to its horizontal position, a support surface 23' of the conveying belts of the conveying device 23 for the second receiving device 18 is positioned higher than a support surface 19' of the first conveying device 19 for the first receiving device 14. The second receiving device 18 furthermore also comprises a support surface 18" for the regions extending past the two conveying belts of the book covers 5' in the stack 15' of book covers 5' with different formats. This support surface 18" is provided with a marking 18'" of a vertical plane through a second center axis 18' of the second receiving device 18 (FIG. 9). The conveying device 23 of the second receiving device 18 is connected via a second chain drive 26 to a second drive motor 27 (FIG. 3).

Referring to FIG. 9, the first and the second receiving devices 14, 18 are embodied such that relative to a second imaginary vertical plane oriented parallel to the transporting direction 16 through the second center axis 18' of the second receiving device 18, a first imaginary vertical plane that is oriented parallel to the transporting direction 16 through a first center axis 14' of the first receiving device 14, is displaced by a distance 28 transverse to the transporting direction. Relative to the transporting direction 16, the centering device 20 is arranged on one side of the first receiving device 14 which is positioned closer to the second imaginary vertical plane through the second center axis 18' of the second receiving device 18, extended into the first receiving device 14, than to the first imaginary vertical plane through the first center axis 14' of the receiving device 14 (FIG. 9).

Referring to FIG. 2, the cover magazine 17 comprises a stacking chute 29 with two side guides 29' which can jointly be adjusted to the format of the book covers 5, 5' to be supplied with a conveying device 30, formed by two spaced-apart conveying belts, and a first separating device 31 for withdrawing the respectively lowest book cover 5, 5' from the stacking chute 29, as well as for making available the withdrawn book cover 5, 5' to the following production unit 10' of the book completion line 1. When supplying book covers 5 having the same format, the stacking chute 29 serves to form a stack. When supplying of book covers 5' with different formats, a single book cover 5' only is located in the stacking chute 29 and is deposited defined with the aid of the side guides 29' on the conveying belts of the conveying device 30 for the cover magazine 17.

Figure 4:
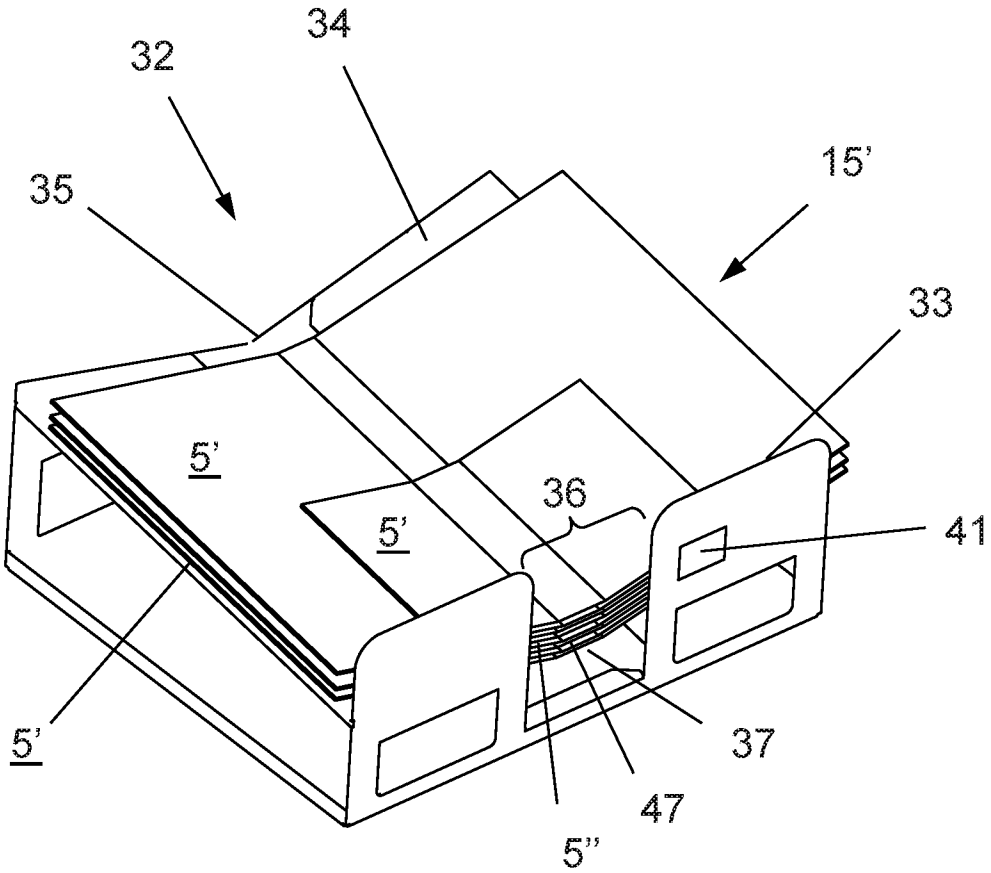
FIG. 4 is a perspective view from the top onto a stacking device for the cover feeder according to the invention.

Supplying the second receiving device 18 with at least one stack 15' of book covers 5' having different formats can advantageously be realized with at least one stacking device 32 (FIG. 4), assigned to the cover feeder 9, for forming stacks 15' of book covers 5' having different formats, aligned centrally in the middle, wherein the stacking device 32 is embodied such that it can be transported to the second receiving device 18. The transport in this case can be realized manually or automatically. The stacking device 32 is provided with a contact surface 33 for leading edges 5" of the book covers 5' in the stack 15' to be formed, as well as a roof-shaped support surface 34 that is inclined in the direction of the contact surface 33 and comprises a downward-pointing ridge 35 for holding the book covers 5'. Also conceivable is a solution with an upward-pointing ridge 35. Owing to the inclination of the support surface 34, the book covers 5' positioned thereon automatically slide in the direction of the contact surface 33 and, if applicable, come to rest against it. The contact surface 33 is provided in the region of the ridge 35 with a first recess 36 that is open toward the top, and the roof-shaped support surface 34 comprises at least one second recess 37 in the region of the contact surface 33 and the ridge 35. These recesses 36, 37 serve to make possible an easier handling of the stacking device 32 as well as to allow a better removal of the respective stack 15' from the stacking device 32. Of course, several stacking devices 32 can also be provided for the cover feeder 9. Alternative to having one or several such stacking devices 32, stacks 15' of book covers 5' having different formats can also be formed in a different way and can be transported to the second receiving device 18, for example via other stacking devices or manually.

Figure 4A:
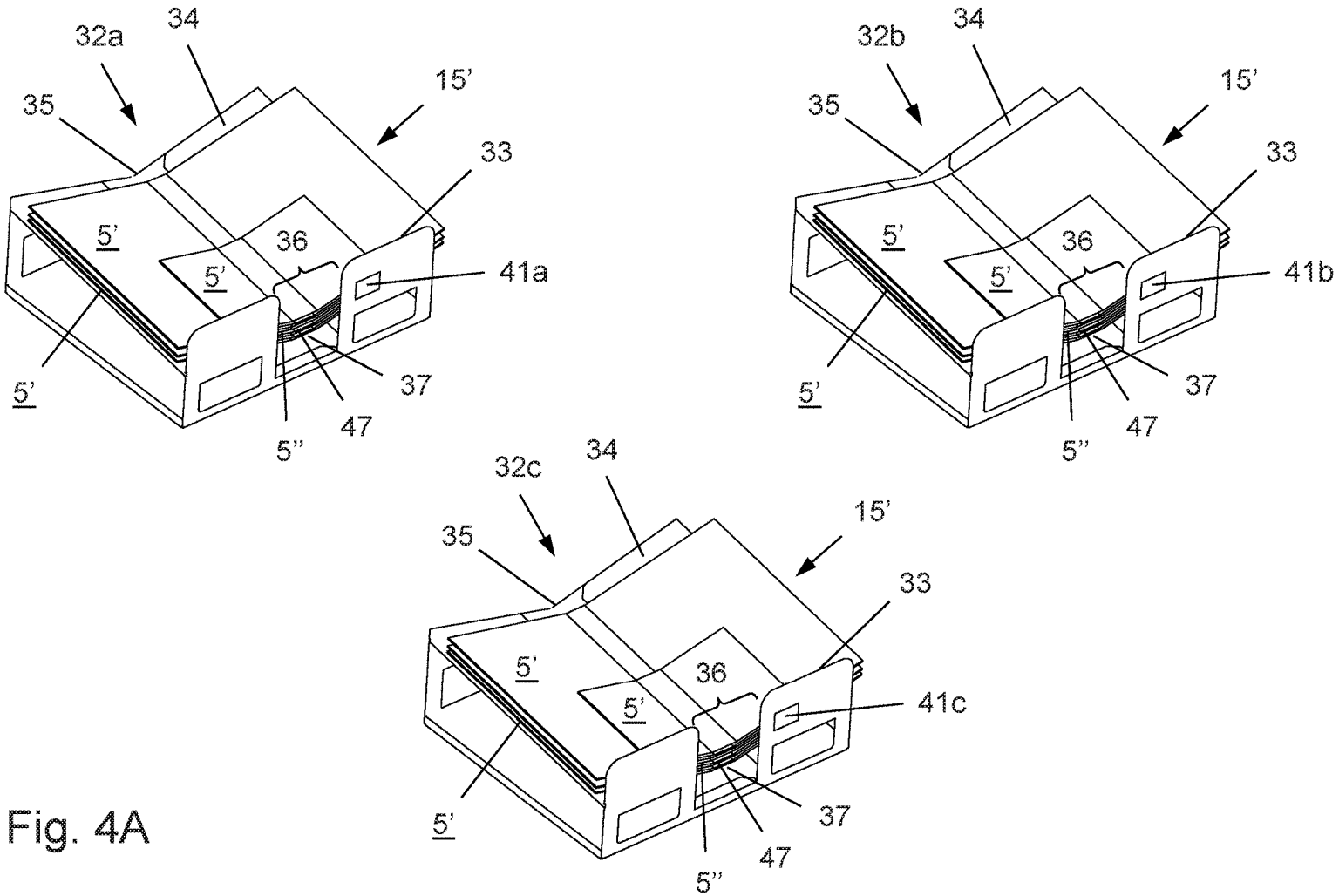
FIG. 4A is a perspective view from the top of a plurality of stacking devices for use with the cover feeder according to another embodiment of the invention.

The cover feeder 9 comprises a control unit 38 (FIG. 2) to which information can be transmitted relating to the format and sequence of the book covers 5' in the stack 15' of book covers 5' having different formats. For this, a first sensor 39 is connected to the control unit 38 and is embodied such that it is, or can be, focused onto an identifier 40 (FIG. 6) for the format and sequence of book covers 5' in the stack 15', which stack 15' is positioned on the second receiving device 18 or the at least one stacking device 32. For this, the identifier 40 can be located at a leading edge 5" of the at least one book cover 5' in the stack 15' and/or the stacking device 32. Accordingly, the first sensor 39 can be attached to the second receiving device 18 or the region surrounding it, but can also be manually focused by a machine operator onto the stack 15' or the stacking device 32. When using several stacking devices as shown in FIG. 4A, each stacking device 32*a*, 32*b*, 32*c*, for example, can be provided for its identification with a separate identifier 41*a*, 41*b*, 41*c*, for example with a barcode or a RFID (radio frequency identification device), that identifies the format and sequence of the stack of book covers forming the stack on the respective stacking device. Following the identification of a new stack 15' of book covers 5' with different formats, for example with the first sensor 39, this stack 15' is manually removed from the stacking device 32 and is placed approximately in the center onto the receiving device 18.

The control unit 38 is additionally connected to the cover magazine 17 and the centering device 20 (FIG. 2). Alternatively or in addition to the defined feeding from the side of the book covers 5 having the same format to form the stack 15 on the first receiving device 14, the centering device 20 can furthermore serve to laterally displace and/or align the book covers 5' withdrawn from the second receiving device 18 and positioned on the first receiving device 14, corresponding to the information relating to the format and sequence of the book covers 5' in the stack 15' of book covers 5' having different formats, and corresponding to the centering required for the following, fourth production unit 10' of the book completion line 1.

Additional sensors are furthermore arranged in the region of the cover feeder 9 and are also connected to the control unit 38 (FIG. 2). In particular, these include a second sensor 42 for identifying book covers 5', withdrawn from the second receiving device 18 and conveyed further to the first receiving device 14, a third sensor 44 that is directed toward a downstream region 43 of the first receiving device 14, and a fourth sensor 45 (FIG. 3), arranged in a region below the conveying devices 19, 23 of the first and second receiving devices 14, 18 for detecting a gap between two successively following book covers 5' withdrawn from the receiving device 18 (FIG. 3).

In the downstream region 43 of the first receiving device 14, a clocked load element 46, embodied as a roll, functions to press the book covers 5, 5' which are transported individually, in an overlapping flow and/or as a stack 15, 15' against the conveying device 19 of the first receiving device 14 (FIG. 2).

In operation, for an order to produce books having the same format, book covers 5 of the same format are initially deposited during the cover feeder 9 operation either individually, in an overlapping flow and/or as a stack 15 onto the first receiving device 14 or its conveying device 19 (FIG. 5), are then processed further in the cover feeder 9 and are provided to the production unit 10', embodied as casing-in machine, of the book completion line 1. With a production order of this type, the second receiving device 18 remains empty, meaning no stack 15' of book covers 5' having different formats is deposited thereon.

Figure 7:
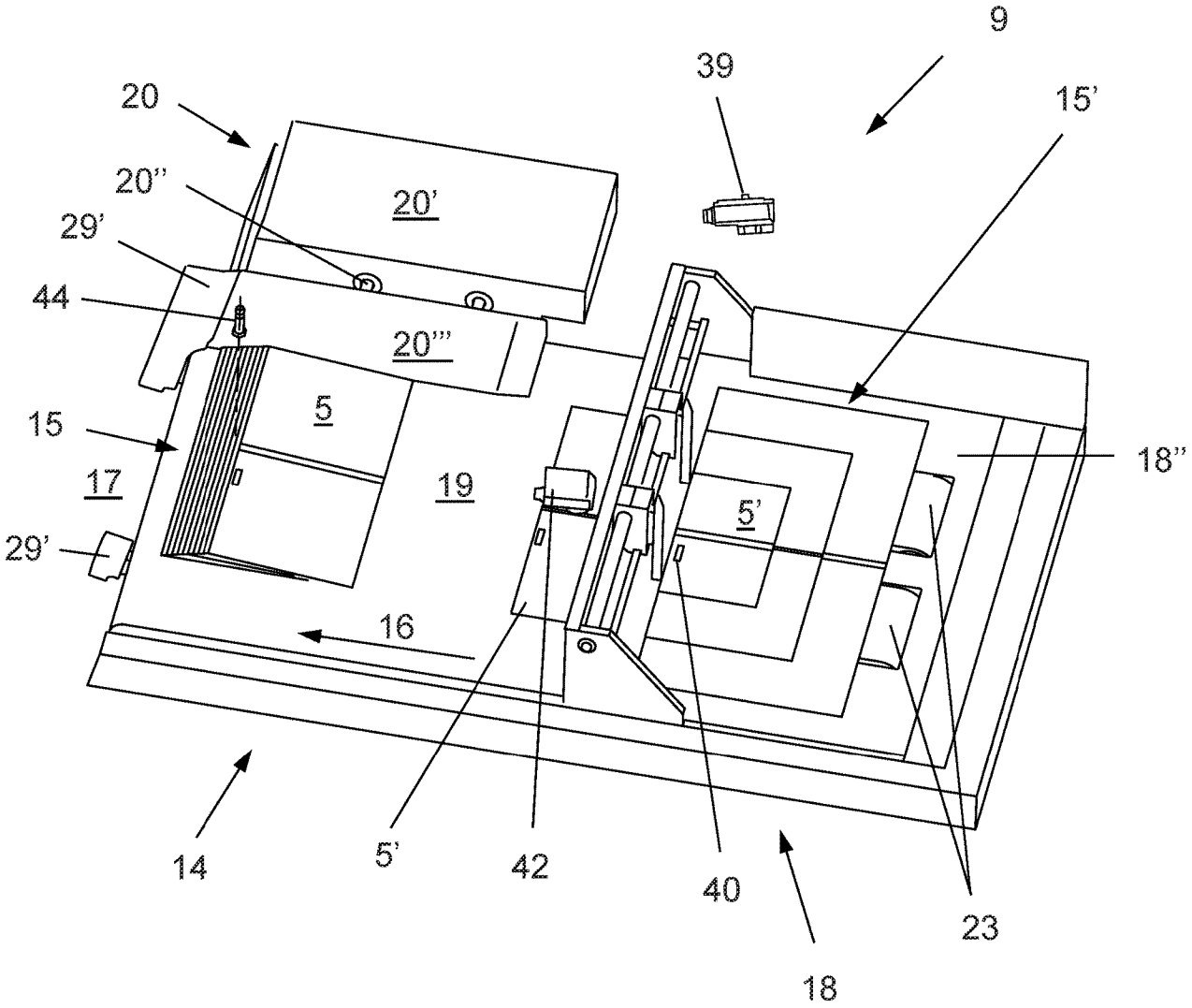
FIG. 7 is a representation of the cover feeder with a stack of book covers having the same format resting on the first receiving device and a stack of book covers having different formats resting on the second receiving device.

However, with an order for producing books having different formats which follow sequentially, a stack 15' of book covers 5' with different formats is deposited on the second receiving device 18 or its conveying device 23 (FIG. 6) while the first receiving device 14 remains empty. Depending on the type of production order and the sequence, the book covers 5, 5' can be deposited simultaneously or with a time delay onto both receiving devices 14, 18 (FIG. 7).

The sequence of operational steps is described further in the following, starting with a stack 15' of book covers 5' having different formats, shown in FIG. 6, which are deposited on the second receiving device 18 or its conveying device 23. The marking 18''' on the second receiving device 18 is used for depositing the book covers 5' in the stack 15' with their respective back areas 47 one above the other, such that they are centered in the middle, and extend transverse to the transporting direction 16. The first sensor 39, which is fixedly installed or held by a machine operator, detects which production order is the current one via the identifier 40 on the top book cover 5' of the stack 15' and transmits this information to the control unit 38. The control unit 38 furthermore knows the sequence in which the book covers 5' in the stack 15' are deposited and the format of the individual book covers 5'.

Of course, this information can also be transmitted to the control unit 38 without such a first sensor 39. For example, the information relating to the work order can be transmitted based on a data file, can be input via computer keyboard by the machine operator, or can be based on a differently acquired dataset. The basic data can be derived from the production of the book covers 5' having different formats, or can also be based on the stacking sequence for the respective stack 15' of book covers 5' having different formats.

Initially, the lowest book cover 5' in the stack 15' is withdrawn with the aid of the two conveying belts of the conveying device 23, as well as the second separating out device 24, and is then conveyed further in the transporting direction 16 to the first receiving device 14. During the withdrawing, the additional book covers 5' in the stack rest against the holding back devices 25 of the second receiving device 18, thereby ensuring that only the book cover 5' that rests directly on the conveying belts is actually pulled out from under the stack 15'. Shown herein is a book cover 5' which has been withdrawn far enough from the stack 15' so that it could be identified by the downstream arranged second sensor 42 via its identifier 40. At that point in time, the centering element 20''' of the first receiving device 14 is at a sufficient distance to the leading edge 5'' of the separated out book cover 5'.

Figure 8:
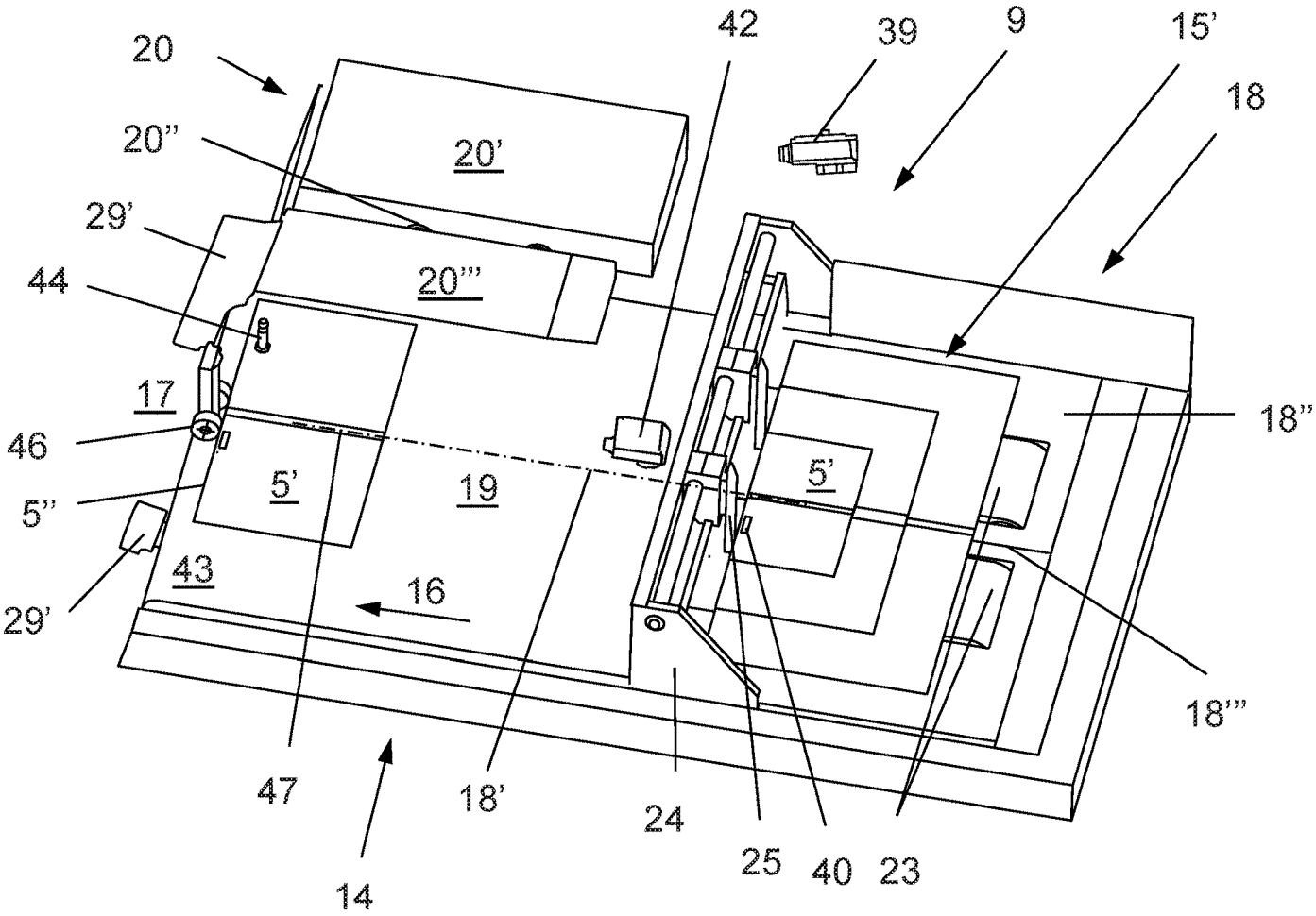
FIG. 8 is a representation of the cover feeder analogous to FIG. 6, but showing a later instant during the processing.

FIG. 8 shows a situation at a later point in time during the operation, wherein the book cover 5' that is withdrawn from the second receiving device 18 is transported with the first conveying device 19 in transporting direction 16 to the downstream region 43 of the first receiving device 14 and, following the identification of its leading edge 5'' with the third sensor 44, is stopped shortly before reaching the cover magazine 17. The book cover 5' is thus laterally displaced a distance by the centering element 20''' so that the book back region 47 is centrally positioned over the extended second center axis 18' of the second receiving device 18 that is extended into the first receiving device 14.

FIG. 9 shows a later point in time during the operation where the centering element 20''' has been moved far enough with the aid of an actuator 48 (FIG. 2), which is connected to the base element 20' of the centering device 20 and the control unit 38 and by correspondingly extending out the guide rods 20'', so that while resting on the book cover 5' it displaces and/or aligns this cover on the first conveying device 19 by a distance 28, such that the book back region 47 comes to rest in the vertical plane through the first center axis 14' of the first receiving device 14. Based on the identifier 40 previously read with the aid of the first sensor 39, the control unit 38 has identified the format, meaning the book cover 5' dimensions, as well as the sequence and format of the additional book covers in the stack and consequently triggers the actuator 48 with a signal, corresponding to the centering required for the production unit 10' of the book completion line 1.

With an alternative cover feeder 9, not shown herein, for which the vertical plane extending parallel to the transporting direction 16 through a first center axis 14' of the first receiving device 14 and the vertical plane extending parallel through a second center axis 18' of the second receiving device 18 coincide, the centering device 20 is respectively adjusted to the format of the book cover 5', separated out of the second receiving device 18 and conveyed to the first receiving device 14, so that the book cover 5 subsequently only needs to be aligned. The centering element 20''' is provided for this with a slanted edge. With this alternative embodiment, a centering device 20 of this type can also be provided on both sides of the first receiving device 14.

Figure 10:
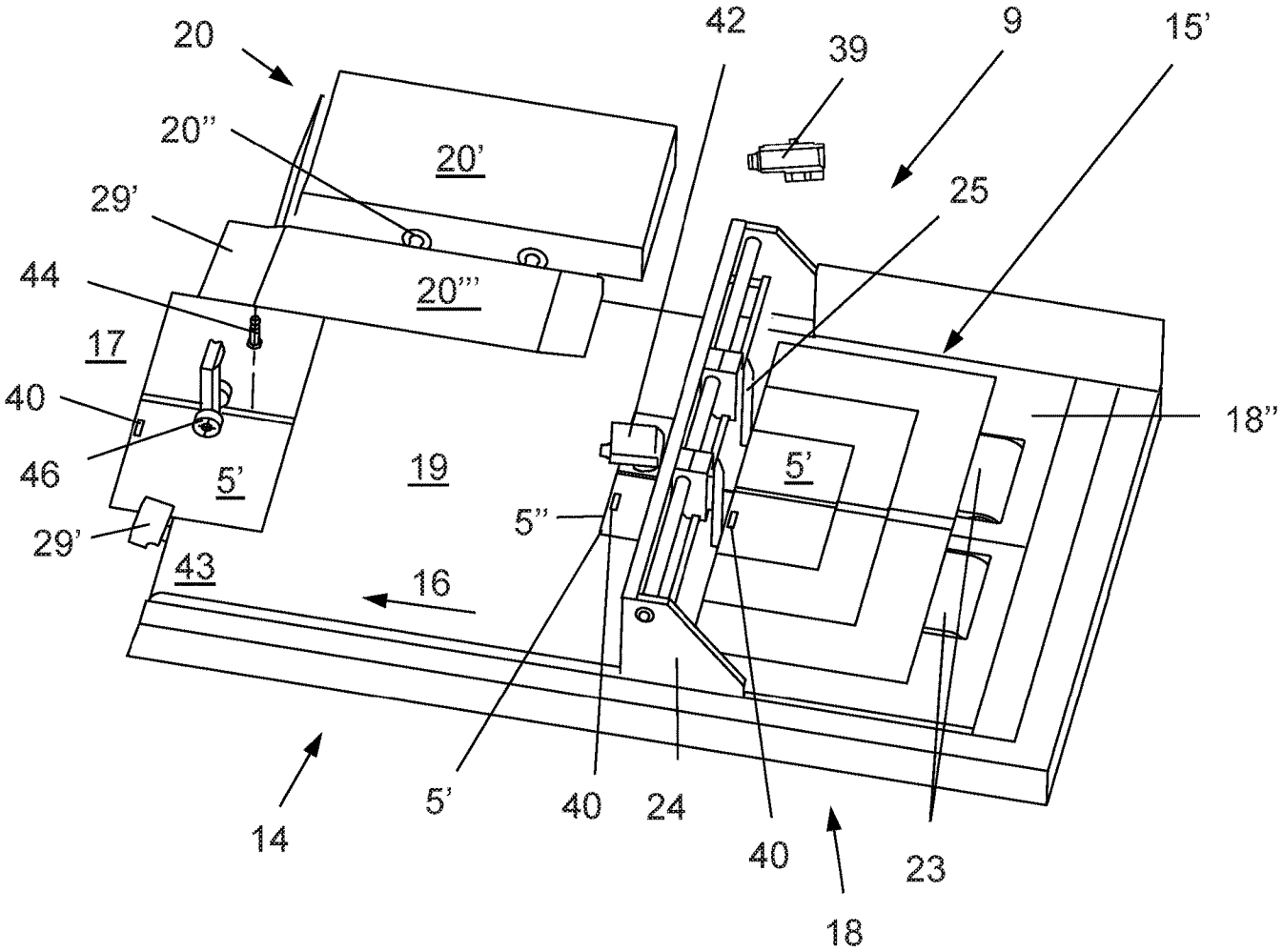
FIG. 10 is a representation of the cover feeder analogous to FIG. 9, but showing a later instant during the processing.

FIG. 10 shows a situation at a later operational point in time where the first conveying device 19 has been moved far enough in transporting direction 16, so that the book cover 5' positioned thereon has been conveyed in the direction of the cover magazine 17, not shown further herein. The clocked load element 46 that rolls off the book cover 5', in particular, prevents an early tilting of book covers with smaller formats into the lower-positioned stacking chute 29 of the cover magazine 17 (FIG. 2). Book covers 5' of all successively following formats can thus advantageously be conveyed to the cover magazine 17 while centered and/or aligned. The respectively lowest book cover 5' is withdrawn in a clocked operation from this stacking chute 29 with the aid of the conveying device 30 and the first separating device 31 and is thus made available to the following production unit 10' of the book completion line 1.

While the leading book cover 5' has been made available for a further conveying to the cover magazine 17, as described, the two conveying belts of the conveying device 23 for the second receiving device 18 are actuated with the second drive motor 27 (FIG. 3), owing to a following cover being called up, and the book cover 5' which rests directly on these conveying belts and has a different format than the preceding book cover 5' is withdrawn from the stack 15'. A simultaneous transporting of additional book covers 5' having different formats, which rest on the separated out book cover 5', is prevented with the aid of the holding back device 25.

As soon as the leading edge 5" in the transporting direction 16 of the following book cover 5' has moved past the fourth sensor 45, arranged below the conveying devices 19, 23 (FIG. 3), a fixed interval runs down in the control unit 38, after which the second drive motor 27 is stopped. As a result, this book cover 5' is initially transported only far enough so that the identifier 40 affixed to its top surface can be read by the second sensor 42. Ideally, all book covers 5' are transported far enough so that their leading edges 5" always stop at the same location. The trailing book cover 5' shown in FIG. 10 still rests with an essential portion on the stopped conveying belts of the conveying device 23 for the second receiving device 18 and is pressed onto the conveying belts by the stack 15' positioned above. Since the support surfaces 23' of the conveying belts for this conveying device 23 are additionally positioned higher horizontally than the support surface 19' of the first conveying device 19 of the first receiving device 18, the conveying belt of the first conveying device 19 initially slides through below the separated book cover 5' (FIG. 3). The centering element 20'" of the first receiving device 14, which at that point still guides the leading book cover 5', is positioned at a sufficient distance to the leading edge 5" of the book cover 5' pulled from the stack 15'.

As soon as the first receiving device 14 is empty and the centering element 20'" of the centering device 20 has been adjusted to the format of the following book cover 5', this cover is transported with the conveying device 19 to the third sensor 44 and/or into the downstream region 43 of the first receiving device 14. For this, the first drive motor 22 and thus the conveying device 19 of the first receiving device 14 as well as the second drive motor 27 and thus the conveying device 23 of the second receiving device 18 start operation. The speeds of the drive motors 22, 27 and thus the speeds of the conveying devices 19, 23 are adjusted such that a gap forms between the book cover 5' that is withdrawn from the second receiving device 18 and the following book cover 5' in the stack 15' of book covers having different formats. The fourth sensor 45 detects this gap, so that the trailing book cover 5' can be stopped by the control unit 38 in such a way that the second sensor 42 can read the identifier 40 for this book cover 5'.

According to FIG. 10, two identified book covers 5' are therefore available in the cover feeder 9 for the further processing and can be processed in the book completion line 1 together with the associated book blocks 4 to form the respective books 3.

Figure 11:
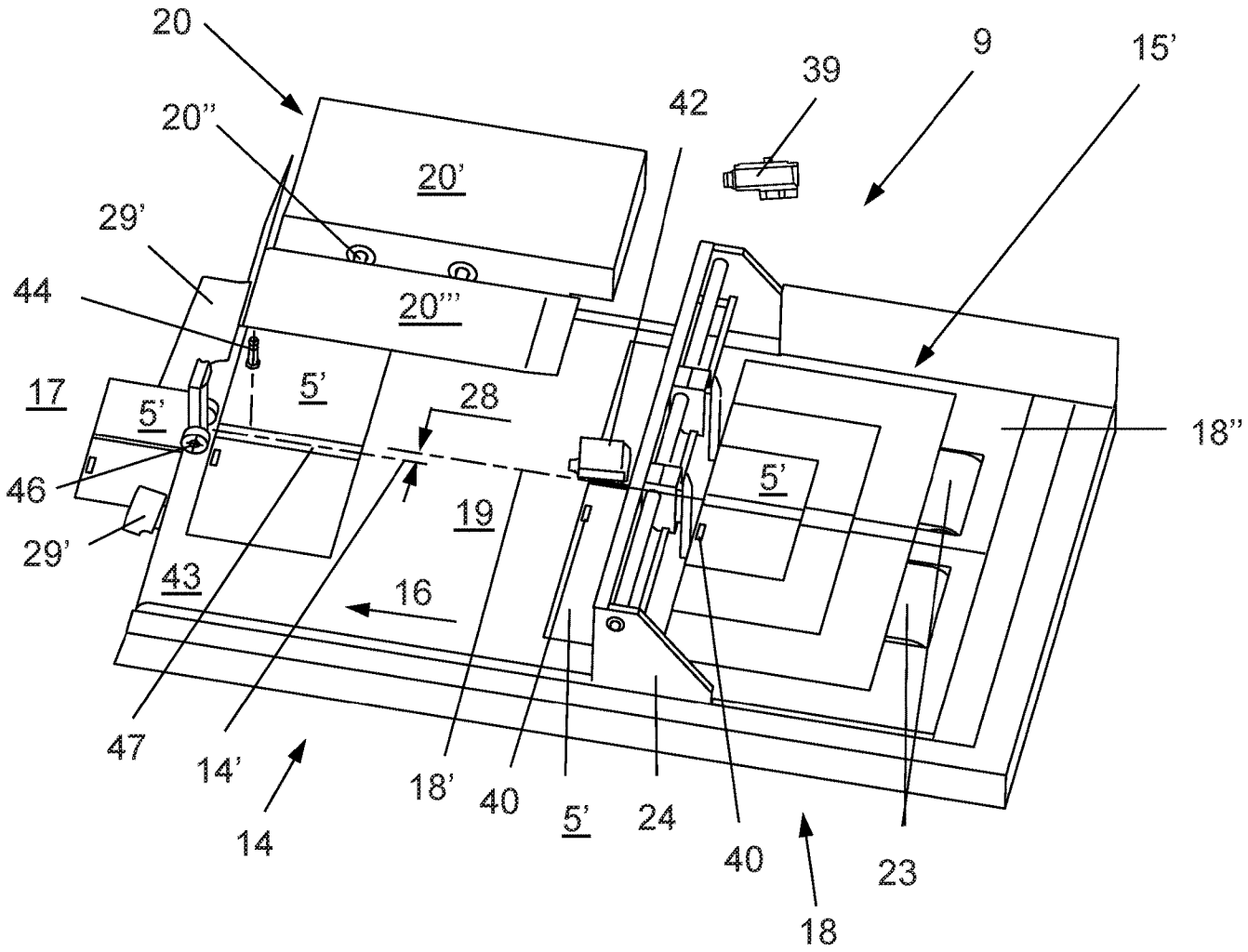
FIG. 11 is a representation of the cover feeder analogous to FIG. 10, but showing a later instant during the processing.

Corresponding to FIG. 11, a first book cover 5' is located in the cover magazine 17 and a second book cover 5' is located in the downstream region 43 of the first receiving device 14. Another book cover 5' has furthermore been separated out far enough from the second receiving device 18, so that its identifier 40 can be read by the second sensor 42. At present, three separated out and identified book covers 5', but depending on the point in time of viewing at least two covers, are thus available for the further processing.

Starting with the representation in FIG. 11, as soon as the book cover 5' in the cover magazine 17 has been transferred in a clocked operation to the production unit 10', embodied as casing-in machine, the side guides 29' of the stacking chute 29 for the cover magazine 17 are adjusted to the new format of the book cover 5' that follows in this cover feeder 9 region, independent of the centering element 20'" for the centering device. The following book cover 5', previously positioned in the downstream region 43 of the first receiving device 14, is subsequently transported with the first conveying device 19 and with the help of the load element 46 into the stacking chute 29 of the cover magazine 17.

As soon as the first conveying device 19 in the operating range of the centering element 20'" for the centering device 20 is empty, the centering element 20'" is adjusted with the aid of the guide rods 20" and the actuator 48 to the new format of the following book cover 5', which at that point is separated out partially from the second receiving device 18. The book cover 5' is then transported into the downstream region 43 of the first receiving device 14, meaning to the third sensor 44, meaning initially with the conveying device 23 of the second receiving device 18 as well as the first conveying device 19 of the first receiving device 14, but later on only with the latter. With the aid of the centering element 20", this book cover 5' is then displaced and/or aligned, so that it is positioned with the back region 47 in the vertical plane through the first center axis 14' of the first receiving device 14. The next book cover 5' in the stack 15' is then separated out far enough so that the second sensor 42 can detect its identifier 40. Alternative thereto, the conveying device 23 of the second receiving device 18 can already be stopped once the fourth sensor 45 has detected a gap between two successive book covers 5' and thus a trailing edge 5" of the leading book cover 5'. In that case, the following book cover 5' in the stack 15' is deposited onto the conveying belts of the conveying device 23 and for the time being remains in this waiting position.

Figure 12:
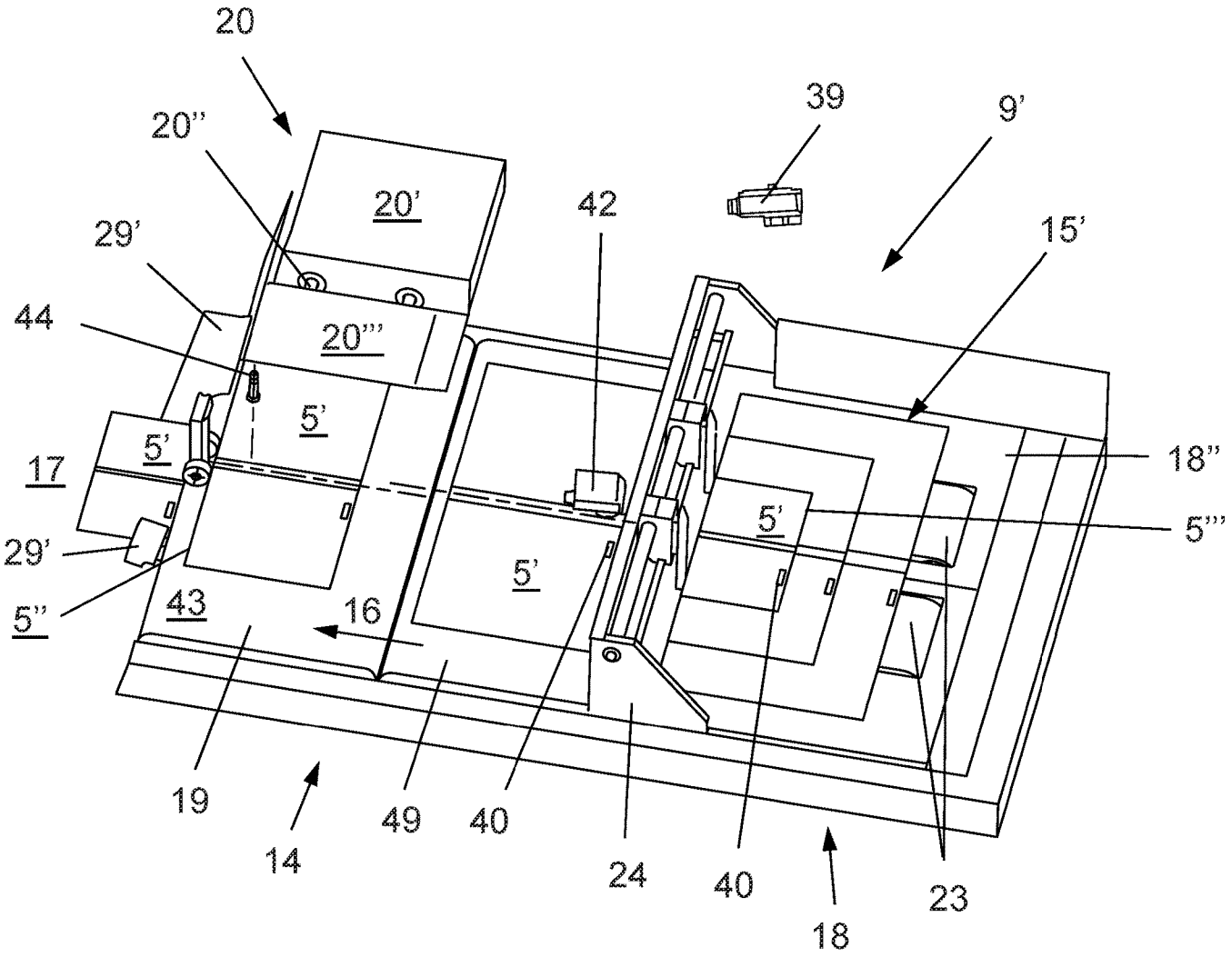
FIG. 12 is a representation of a second exemplary embodiment of the cover feeder according to the invention, analogous to FIG. 6, but with a first receiving device divided into two successive conveying regions for book blocks with identifiers arranged on a trailing edge.

FIG. 12 shows a different embodiment of a cover feeder 9' according to the invention which, in contrast to the previously described example, is suitable for processing stacks 15' of book covers 5' with an identifier 40 affixed to a trailing edge 5'" of the book cover 5'. The first receiving device 14 is provided for this with a second conveying device 49, also embodied as conveying belt, which is arranged between the second receiving device 18 and the first conveying device 19 of the first receiving device 14. The second conveying device 49 comprises a drive motor that is not shown. In addition, the first conveying device 19 of the first receiving device 14 and the cooperating centering device 20 are embodied shorter. Both conveying devices 19, 49 of the first receiving device 14 are designed to be at least long enough to accommodate a book cover 5' with the maximum possible dimensions intended for the cover feeder 9' and thus have approximately the same longitudinal extension in transporting direction 16.

As shown, three separated out book covers 5', but depending on the reviewing instant, at least two separated out and identified book covers 5' can be made available for the further processing when using a cover feeder 9' embodied in this way. FIG. 12 shows that a first identified book cover 5' is still located in the cover magazine 17 while the second identified book cover 5' is positioned with its leading edge 5" in the downstream region 43 of the first conveying device 19. The third book cover 5' separated out of the stack 15' of book covers 5' with different formats is deposited completely on the second conveying device 49 of the first receiving device 14, which is stopped at that point in time, so that its identifier 40 affixed to its trailing edge 5'" can also be identified with the aid of the second sensor 42. However, this book cover 5' can be conveyed to the first conveying device 19 only after the leading book cover 5', positioned on the first conveying device 19 of the first receiving device 14, has been moved to the cover magazine 17 during the following machine cycle and, following a corresponding adjustment of the centering device 20, can be displaced to the side and/or aligned thereon, so that it finally can be made available for the further processing. At the same time, the lowest book cover 5' can be separated out of the stack 15'.

Since the cover magazine 17 and the upstream arranged first receiving device 14 have a relatively short design and after the book cover 5' in the stacking chute 29 has been conveyed further, the side guides 29' of the cover magazine 17 can be converted relatively quickly to the format of the following book cover 5', positioned on the first conveying device 19 for the first receiving device 14. This available book cover 5' can thus also be moved relatively quickly into the stacking chute 29 of the cover magazine 17 and from there can be made available for the further processing in the casing-in machine of the fourth operating region 10' for the book completion line 1. During the format adjustment of the side guides 29' of the stacking chute 29, the centering element 20''' of the centering device 20 can be moved back, so that simultaneous with the further conveying of the book cover 5' on the first conveying device 19 to the cover magazine 17, the following book cover 5' can also be separated out completely from the second receiving device 18. Following this, the identifier 40 is detected with the aid of the second sensor 42 and the book cover is initially transported on the second conveying device 49 and then on the first conveying device 19 to the third sensor 44. There, the book cover 5' is again displaced to the side and/or aligned corresponding to the signal produced by the control unit 38 from the information relating to the format and sequence of the book covers 5' in the stack 15' and corresponding to the centering required for the production unit 10' in the book completion line 1.

With all other production units 6', 7', 8', 10' of the book completion line 1 and following the format changeover, the following book block 4 must still be transported to the downstream end in main production direction 2 of the respective operating region 6, 7, 8, 10 which in practical operations is equal to eight operating cycles. In contrast, when using the inventive cover feeder 9, 9', respectively the corresponding method, making available the next book cover 5, 5' requires only a single cycle following the format change.

With reference to FIGS. 1 and 11, the book block 4 belonging to the book cover 5' located in the cover magazine 17 of the cover feeder 9, is therefore located in main production direction 2 at the end of the third production unit 8', embodied as a back-lining machine, of the book completion line 1. As soon as the fourth production unit 10', embodied as casing-in machine, is adjusted to the format of this book cover 5', the book cover 5' as well as the associated book block 4 can be clocked in. The book block 4 belonging to the book cover 5', positioned on the first receiving device 14 of the cover feeder 9 in the region of the third sensor 44, is located in main production direction 2 at the end of the second production unit 7' embodied as rounding and pressing machine. The book block which belongs to the book cover 5' that has been separated out partially from the second receiving device 18 is located in main production direction 2 at the end of the first production unit 6' embodied as feeding device.

The identifier 40 on the book cover 5', which is to be separated out of the respectively following stack 15' of book covers 5' having different formats, is therefore known faster than it is possible to transfer the book blocks 4, positioned in the respective production units 6', 7', 8', 10' of the book completion line 1, to the respectively following operating region 6, 7, 8, 10 to be made available at its the end for the next machine cycle. With the cover feeder 9, 9' according to the invention, the identifier 40 on the book cover 5' separated out of the second receiving device 18 can thus advantageously be read fairly quickly and processed by the control unit 38, even before the associated book block 4 is called up.

It will be understood that the above description of the present invention is susceptible to various modifications, changes and adaptations, and that the same are intended to be comprehended within the meaning and range of equivalents of the appended claims.

What is claimed is:

1. A cover feeder for providing book covers to a production unit of a book completion line, the cover feeder comprising:

a first receiving device having a transporting direction and receiving book covers of a same format that are deposited at least one of individually, in an overlapping flow and in a stack on the first receiving device;

a laterally adjustable centering device arranged on the first receiving device for a defined feeding from a side of the first receiving device, relative to the transporting direction, of the book covers deposited individually, in an overlapping flow or in the form of a stack, to a position corresponding to a centering required for the production unit of the book completion line;

a cover magazine, arranged downstream of the first receiving device, comprising a stacking chute and a first separating out device for withdrawing a respectively lowest book cover from the stacking chute and for providing the withdrawn book cover to the production unit of the book completion line;

a second receiving device arranged upstream of the first receiving device for accommodating a stack of book covers having different formats, the second receiving device comprising a second separating out device for withdrawing a respectively lowest book cover from the stack of book covers having different formats, which stack of book covers having different formats rests on the second receiving device, and for conveying in the transporting direction of the first receiving device the separated out book covers of different formats to the first receiving device; and a control unit having an input for receiving information relating to the format and sequence of the book covers in the stack of book covers with different formats, and an output;

wherein the centering device is connected to the output of the control unit for being controlled to be laterally displaced to effect a defined lateral displacement for aligning the respective book covers withdrawn from the second receiving device and positioned on the first receiving device in dependence on the information received by the control unit on format and sequence of the book covers in the stack of book covers with different formats and corresponding to the centering required for the production unit of the book completion line.

2. The cover feeder according to claim 1, wherein the centering device comprises a single centering element.

3. The cover feeder according to claim 1, further comprising at least one stacking device on which to form the stack of book covers having different formats, the at least one stacking device being adapted to centrally align the stack of book covers having different formats in a middle of the stacking device, and wherein the stacking device is adapted to be transported to the second receiving device.

4. The cover feeder according to claim 3, wherein the at least one stacking device comprises a roof-shaped support surface having a ridge inclined toward a top or a bottom of the stacking device for accommodating book covers having different formats, the stacking device including a contact surface against which leading edges of the book covers in the stack to be formed rest.

5. The cover feeder according to claim 4, wherein the roof-shaped support surface is slanted downwardly in a direction of the contact surface.

6. The cover feeder according to claim 5, wherein the contact surface includes a first recess in a region of the ridge that is open toward the top, and the roof-shaped support surface includes at least one second recess in a region of the contact surface and the ridge.

7. The cover feeder according to claim 3, further including a first sensor coupled to the input of the control unit and adapted to be focused toward an identifier for the format and sequence of the book covers in the stack of book covers of different formats positioned on one of the second receiving device or the at least one stacking device for detecting the information corresponding to the format and sequence of the book covers in the stack of book covers of different formats, which information constitutes the information input to the control unit.

8. The cover feeder according to claim 7, wherein the identifier is attached to at least one book cover in the stack of book covers having different formats and/or a separate identifier is attached to the stacking device for forming the stack of book covers having different formats.

9. The cover feeder according to claim 3, wherein the at least one stacking device comprises a plurality of stacking devices and an individual identifier is arranged on each stacking device for identification of the stacking device.

10. The cover feeder according to claim 7, further comprising a second sensor coupled to the control unit and arranged to identify book covers withdrawn from the second receiving device and conveyed further to the first receiving device.

11. The cover feeder according to claim 10, further comprising a third sensor arranged to be focused onto a downstream region of the first receiving device and is coupled to the control unit.

12. The cover feeder according to claim 11, further comprising a fourth sensor arranged on to detect a gap between two book covers of different formats withdrawn successively from the second receiving device and being connected to the control unit.

13. The cover feeder according to claim 12, further comprising a clocked load element arranged in a downstream region of the first receiving device to press book covers positioned individually, in an overlapping flow or in a stack on the first receiving device against the receiving device.

14. The cover feeder according to claim 1, wherein the first and the second receiving devices have a first imaginary vertical plane extending parallel to the transporting direction through a first center axis of the first receiving device and a second imaginary vertical plane extending parallel to the transporting direction through a second center axis of the second receiving device, wherein the first imaginary vertical plane is spaced a distance transverse to the transporting direction from the second imaginary vertical plane, wherein relative to the transporting direction, the centering device is arranged on a side of the first receiving device closer to the second imaginary vertical plane through the second center axis of the second receiving device extended into the first receiving device, than to the first imaginary vertical plane through the first center axis of the first receiving device.

15. The cover feeder according to claim 14, wherein the second receiving device comprises a support surface for the stack of book covers having different formats and the support surface includes a marking of the second imaginary vertical plane through the second center axis.

16. A method for supplying book covers for a production unit of a book completion line, comprising the steps of:

placing book covers of respectively a same format individually, in one of an overlapping flow or in a stack onto a first receiving device of a cover feeder, in a position corresponding to a centering required for the production unit of the book completion line;

conveying the book covers, positioned individually, in an overlapping flow or in a stack, from the first receiving device in a stacking chute of a downstream-arranged cover magazine;

withdrawing respectively a lowest book cover from the stacking chute and providing the withdrawn book cover to the production unit of the book completion line;

depositing a stack of book covers having different formats upstream of the first receiving device onto a second receiving device in addition to or alternative to the placing step;

withdrawing the respectively lowest book cover from the stack of book covers having different formats, which rests on the second receiving device, and conveying the withdrawn lowest book cover further in a transporting direction to the first receiving device;

transmitting information relating to format and sequence of book covers in the stack of book covers having different formats to a control unit of the cover feeder; and laterally displacing, relative to the transporting direction, a respective book cover withdrawn from the second receiving device and positioned on the first receiving device to align the respective book cover withdrawn from the second receiving device and positioned on the first receiving device based on a signal generated by the control unit from the transmitted information relating to format and sequence of the book covers in the stack of book covers having different formats and corresponding to the centering required for the production unit of the book completion line.

17. The method according to claim 16, wherein the depositing step includes depositing the stack of book covers having different formats onto the second receiving device, extending transverse to the transporting direction, and centered over a middle of the second receiving device and with leading edges of the book covers in the stack resting against at least one holding back device of a separating out device belonging to the second receiving device.

18. The method according to claim 17, wherein the depositing step includes depositing the book covers in the stack of book covers having different formats centered in the middle, relative to each other, onto a marking of the second receiving device.

19. The method according to claim 16, including forming a stack of book covers having different formats centered in a middle of at least one stacking device; transporting the stacking device with the stack of book covers having different formats to the second receiving device, removing the stack of book covers having different formats from the stacking device and deposited said covers onto the second receiving device.

20. The method according to claim 16, further including attaching an identifier containing the information relating to format and sequence of the book covers in the stack of book covers having different formats to at least one book cover in said stack or to a stacking device containing said stack.

* * * * *